United States Patent [19]

Postma

[11] Patent Number: 4,876,967

[45] Date of Patent: Oct. 31, 1989

[54] TRANSPORTER FOR PLANT TRAYS

[75] Inventor: Robert Postma, Towaco, N.J.

[73] Assignee: Orie VanWingerden, Pompton Plains, N.J.

[21] Appl. No.: 240,716

[22] Filed: Sep. 6, 1988

[51] Int. Cl.[4] ..... B61C 11/00; B61D 15/12

[52] U.S. Cl. ..... 105/30; 47/1.01; 104/287

[58] Field of Search ..... 105/30, 133, 238.1, 105/463.1; 104/287, 202, 229, 48–50; 47/1 A, 1 R, 58, 46, 48.5, 65, 17

[56] References Cited

U.S. PATENT DOCUMENTS

| | | | |
|---|---|---|---|
| 3,498,236 | 3/1970 | Meek | 105/30 |
| 3,913,758 | 10/1975 | Faircloth et al. | 104/48 X |
| 4,020,881 | 5/1977 | Nöthen | 47/1 A X |
| 4,476,651 | 10/1984 | Drury | 47/65 |
| 4,547,992 | 10/1985 | Wingerden | 47/65 X |
| 4,811,669 | 3/1989 | Dahlman | 105/30 |

*Primary Examiner*—Douglas C. Butler

*Attorney, Agent, or Firm*—Bernard J. Murphy

[57] ABSTRACT

The transporter has a frame which is fastened to a side rail of a foremost one of a plurality of juxtapositioned plant trays. It has an electric motor mounted thereon, and a gear reducer coupled to the output or power end of the motor. The trays are supported on a pair of extended beams by rollers, underlying the trays, and fixed to the trays. The gear reducer drives a sprocket, and three rubber-tired wheels are rotatably supported by the frame and engage one of the beams; two of the wheels engage one side of the beam, and the other is equi-distant from the axes of the two and engaged with the beam on the opposite side. Each wheel has an axle journalled in the frame and having a sprocket fixed to an end thereof. A continuous chain is engaged with the driven sprocket, and with the other three; upon the motor being turned on, this causes the wheels to turn and travel along the engaged beam and, in this way, the whole plurality of trays are pushed along the two beams. A wire rope lashes the plurality of trays together so that, alternatively, the motor can be put in an opposite rotation to pull the whole plurality of trays along the beams.

10 Claims, 2 Drawing Sheets

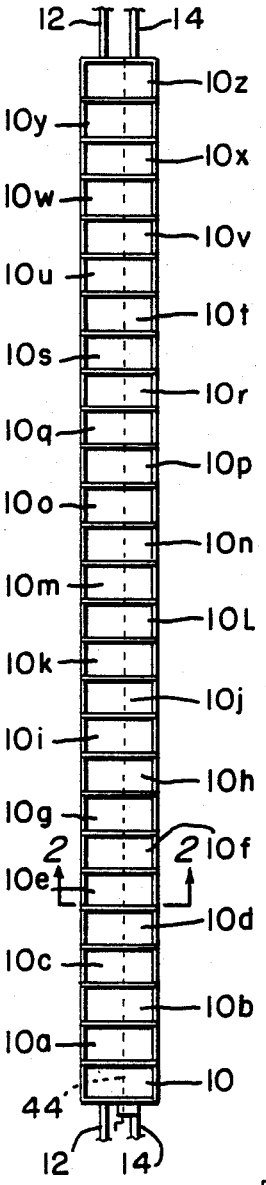
FIG. 1
FIG. 2
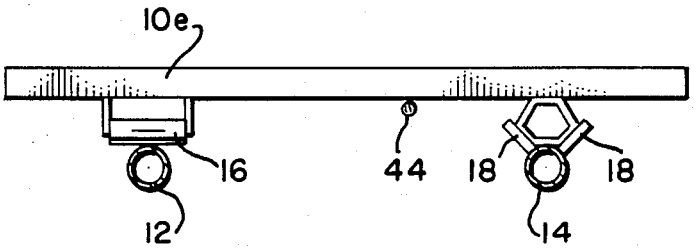
FIG. 4
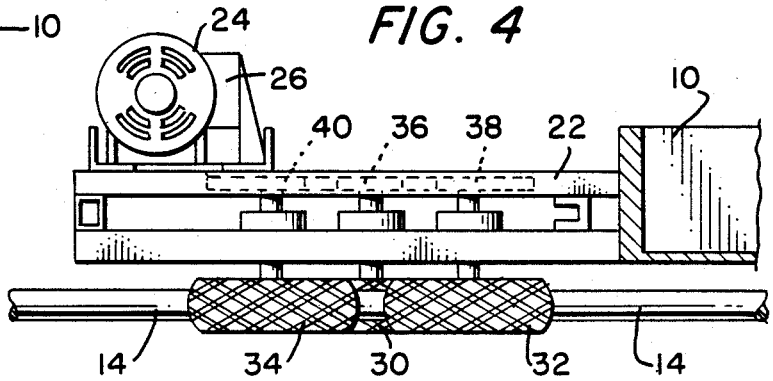

TRANSPORTER FOR PLANT TRAYS

This invention pertains to means for transporting plant trays, great pluralities of plant trays, and in particular to a novel transporter powered by a motor and capable of moving multi-ton pluralities of such plant trays.

In the prior art is is known to support twenty, thirty, or more plant trays on extended beams which stretch from inside a greenhouse to expanses of land hundreds of feed outside of the greenhouse. Commercial nurseries have such facilities in order to move thousands of potted plants, supported on the trays, out of the greenhouses into the natural sunlight and exposed to the rain and ambient environment. When and as the weather dictates, the trays are moved along the beams and returned to the protection of the greenhouses and, to this end, a side wall of each green house is apertured to accommodate the beams thereinto and therethrough, and to allow the trays to move in and out.

It is not uncommon for the pluralities of the trays, set out on the beams in juxtaposition, to weigh a total of fifteen, sixteen or seventeen tons. Now, while the trays have rollers fixed thereunder which ride on the beams, it is still too great a task to move the whole assemblage of trays by hand. Commonly, nurserymen will jerry-rig some sort of apparatus in conjunction with a fork-lift truck, or the like, to move a few of the trays at a time. Doing so, sequentially, will finally get all the trays set out in the ambient atmosphere, or back into the greenhouse. Of course, this is most time-consuming and awkward of practice. What has long been needed is a transporter which can be fixed to a foremost (or hindmost) one of the plurality of juxtapositioned trays and, being powered in some way, move the entirety of the trays in concert.

It is an object of this invention to set forth just such a long sought transporter.

It is particularly an object of this invention to set forth, for plant trays movably supported on elongate beams, a transporter for moving said trays, in unison, along said beams.

Further objects of this invention, as well as the novel features thereof, will become more apparent by reference to the following description, taken in conjunction with the accompanying figures, in which:

FIG. 1 is a plan view of a plurality of juxtapositioned, plant trays, movably supported on a pair of beams, showing an embodiment of the invention coupled to a foremost one of the trays.

FIG. 2 is a view taken along section 2—2 of FIG. 1, the same showing the pair of beams and the rollers (which are common to all of the trays), as well as the traversing wire rope which lashes all of the trays together;

FIG. 4 is a side elevational view, taken along section 4—4 of FIG. 3 (but omitting the wire rope winch).

Figure 3:
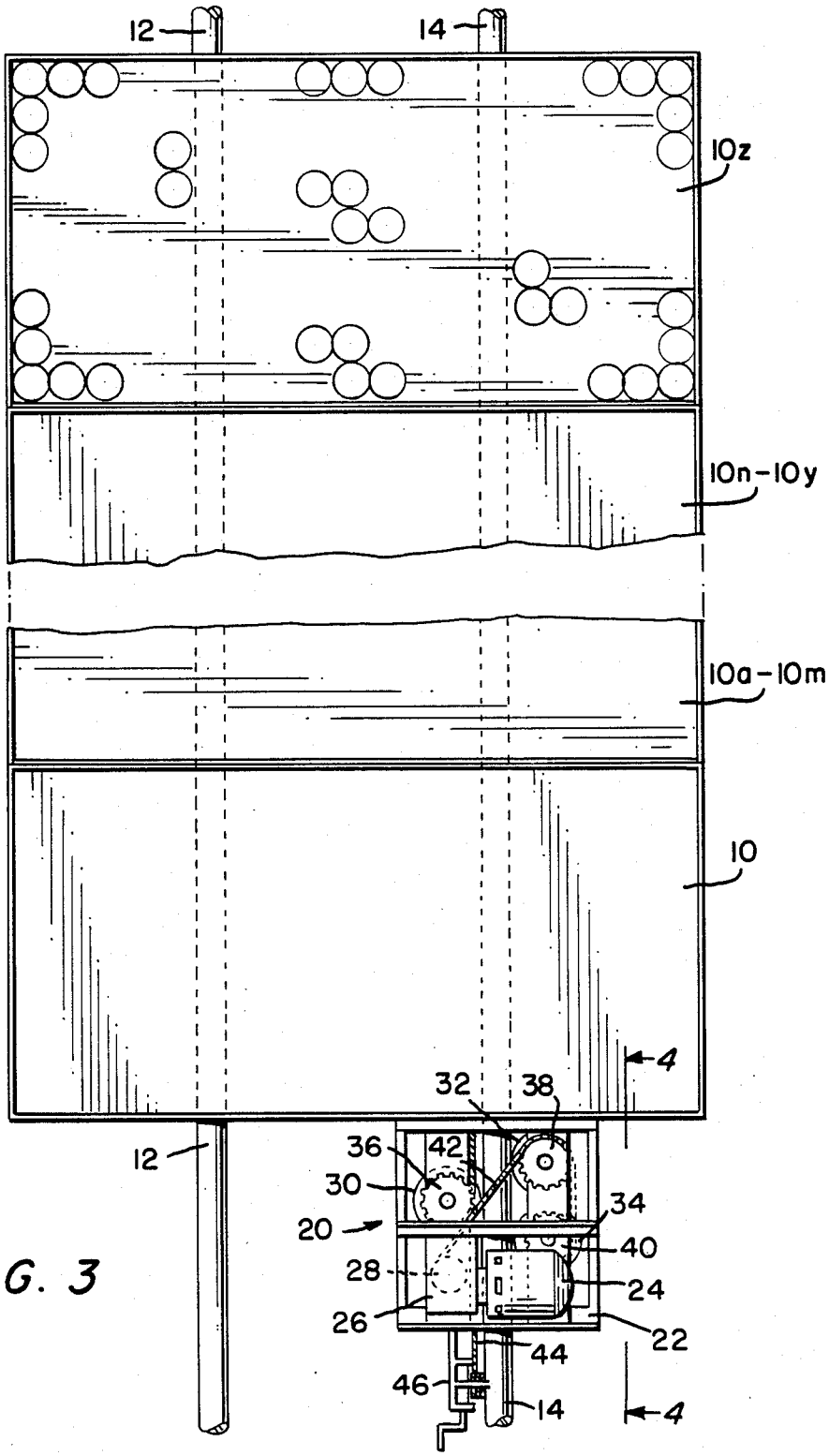
FIG. 3 is another plan view of some of the trays, and showing in greater detail the novel transporter.

As shown in the figures, a plurality of plant trays 10 through 10z are set in juxtaposition on a pair of elongate beams 12 and 14. As is a well-known practice in the prior art, each tray has a parallel roller 16 and a pair of diagonal rollers 18 and **18*a* mounted therebelow to accommodate the rolling movement of the tray along the beams 12 and 14**.

In accordance with the invention, a transporter 20 is mounted to a foremost one of the trays, tray 10. The transporter 20 has a frame 22 which supports a three-phase electric motor 24. The output or drive end of the motor 24 is coupled to a gear reducer 26, and the latter powers a small sprocket 28. The frame further carries three rubber-tired wheels 30, 32 and 34, the three being journaled in the frame on axles which have sprockets 36, 38 and 40 fixed thereto. An endless chain 42 is engaged with the sprockets 38 and 40 to effect rotation thereof in same directions as the sprocket 28 with which the chain is also engaged. Further the chain 42 engages the sprocket 36 to effect rotation thereof in directions opposite those of sprockets 28, 38 and 40. Accordingly, when the motor is turned on (by means not shown) the sprocket 28 will drive the other sprockets and cause the wheels to rotate and travel along the beam 14 with which they are tractionally engaged.

The one rubber-tired wheel 30 is engaged with the beam 14 on one side thereof, and the other wheels are engaged with the beam 14 on the other side thereof, so that a sure, gripping nip of the beam is effected by the wheels 30, 32 and 34. As the frame 22 is fastened to the tray 10, the three-point grip of the wheels 30, 32 34 pushes the whole array of trays 10, **10*a*–10*z* in unison. Too, with reversal of the motor 24, the transporter pulls the whole array in unison. This is made possible by the expedient of lashing the whole array together with wire rope 44**.

The wire rope 44 is fastened to the rearmost tray **10*z*, is passed in traverse of all the trays in the array thereof, to attachment to a winch 46 mounted to the frame 22. The winch is used, of course, to snub up all the trays tightly together, but it is also provided to slacken the wire rope 44 when as as needed to enable workers to get between the trays to minister to the plants thereon. In FIG. 3 some of the potted plants are represented by the circles in tray 10z. As can be appreciated, the trays are of great length, and one cannot reach into the center thereof from a side. By slackening the wire rope 44, a first tray 10 can be backed away by hand, and the plants thereon addressed, and then plants on tray 10a can be tended to. Then tray 10a can be backed off by hand, etc. When all the plants have been ministered to, the winch 46 is used to lash all the trays tightly together for movement into or out of the greenhouse (no shown) along the beams 12 and 14** by means of the novel transporter.

The motor 24 is geared down greatly by the reducer 26, so that the trays during transport move slowly, but surely and together. If moved into the green house, a limit switch can be used at an optimum location to interrupt the circuit and halt the movement when the trays have reached their proper resting place in the greenhouse. So also, out in the field, the outer ends of the beams 12 and 14 can mount similar limit switches to halt the outward movement of the trays. Further, as the trays move slowly and gradually, at a common pace, a steady pace, water sprays can be mounted thereover, at a given location -- for instance, at the entry way into the green house -- to uniformly water the plants as they pass thereunder.

Now, while I have described my invention in connection with a specific embodiment thereof, it is to be clearly understood that this is done only by way of example, and not as a limitation to the scope of my invention as set forth in the objects thereof and in the appended claims.

I claim:

1. For a plurality of juxtpositioned plant trays movably supported on elongate beams, a transporter for moving said plurality, in unison, along said beams, comprising:

a frame fastened to one of such trays;

first means fastening each of said trays together for coincident movement;

second means, supported on said frame, for grippingly engaging one of said beams; and third means, secured to said frame, for moving said beam-engaging means along said one beam; wherein said first means comprises means (a) fastened to a foremost tray of said plurality thereof, (b) fastened to a rearmost tray of said plurality, and (c) in traverse of trays intermediate said foremost and rearmost trays.

2. For a plurality of juxtapositioned plant trays movably supported on elongate beams, a transporter for moving said plurality, in unison, along said beams, comprising:

a frame fastened to one of such trays;

first means fastening each of said trays together for coincident movement;

second means, supported on said frame, for grippingly engaging one of said beams; and third means, secured to said frame, for moving said beam-engaging means along said one beam; wherein said first means comprises a wire rope.

3. A transporter, according to claim 2, wherein:

said first means further comprises a winch mounted to a foremost one of said trays of said plurality thereof, and having an end of said wire rope coupled thereto.

4. A transporter, according to claim 2, further including;

a winch, coupled to said one tray, and having an end of said wire rope coupled thereto.

5. For a plurality of juxtapositioned plant trays movably supported on elongate beams, a transporter for moving said plurality, in unison, along said beams, comprising:

a frame fastened to one of such trays;

first means fastening each of said trays together for coincident movement;

second means, supported on said frame, for grippingly engaging one of said beams; and third means, secured to said frame, for moving said beam-engaging means along said one beam; wherein said engaging means comprises a plurality of movable traction elements, one of said elements being on one side of said one beam, and another one of said elements being on the other, opposite side of said one beam.

6. A transporter, according to claim 5, wherein:

said traction elements comprise tired wheels.

7. A plurality of juxtapositioned plant trays movably supported on elongate beams, a transporter for moving said plurality, in unison, along said beams, comprising:

a frame fastened to one of such trays;

first means fastening each of said trays together for coincident movement;

second means, supported on said frame, for grippingly engaging one of said beams; and third means, secured to said frame, for moving said beam-engaging means along said one beam; wherein said engaging means comprises a plurality of movable traction elements, two of said traction elements being on one side of said one beam, and one of said traction elements being on the other, opposite side of said one beam.

8. A transporter, according to claim 7, wherein:

said third means comprises a prime mover having a sprocket drivenly coupled thereto, sprockets integrally joined to said traction elements, and an endless chain enwrapped about said sprockets.

9. A transporter, according to claim 8, wherein:

said traction elements comprise rubber-tired wheels;

each said wheel has an axle jounalled in said frame; and each said axle has one of said sprockets fastened thereto.

10. For a plurality of juxtapositioned plant trays movably supported on elongate beams, a transporter for moving said plurality, in unison, along said beams, comprising:

a frame fastened to one of such trays;

first means fastening each of said trays together for coincident movement;

second means, supported on said frame, for grippingly engaging one of said beams; and third means, secured to said frame, for moving said beam-engaging means along said one beam; wherein said second means comprises means effecting a three-point, nipping engagement with said one beam.

* * * * *